United States Patent [19]

Bialkowski

[11] Patent Number: 4,475,818

[45] Date of Patent: Oct. 9, 1984

[54] ASPHALT COATING MIX AUTOMATIC LIMESTONE CONTROL

[76] Inventor: Wojciech L. Bialkowski, 121 Wright St., Richmond Hill, Ontario, Canada

[21] Appl. No.: 526,430

[22] Filed: Aug. 25, 1983

Related U.S. Application Data

[63] Continuation of Ser. No. 303,369, Sep. 15, 1981, abandoned.

[51] Int. Cl.[3] ..... B28C 7/04

[52] U.S. Cl. ..... 366/17; 366/18; 366/20; 366/152; 366/162

[58] Field of Search ..... 366/16, 17, 18, 19, 366/20, 21, 136, 137, 152, 160, 161, 162, 601

[56] References Cited

U.S. PATENT DOCUMENTS

| | | | |
|---|---|---|---|
| 2,709,843 | 6/1955 | Hartley | 366/17 |
| 2,863,191 | 12/1958 | Dietert | 366/17 |
| 2,902,681 | 9/1959 | Dietert | 366/16 |
| 3,004,544 | 10/1961 | Guptill | 366/17 |
| 3,256,181 | 6/1966 | Zingg | 366/160 |
| 3,379,421 | 4/1968 | Putman | 366/18 |
| 3,910,564 | 10/1975 | Graham | 366/18 |
| 4,089,509 | 5/1978 | Morton | 366/17 |
| 4,325,641 | 4/1982 | Babus et al. | 366/18 |

*Primary Examiner*—Timothy F. Simone

[57] ABSTRACT

The viscosity and amount of limestone in a limestone asphalt mixture (filled coating mixture) is determined sensing the density of the mixture which will indicate the percent of limestone in the mixture and also sensing the temperature of the mixture, and adjusting the ratio of limestone to asphalt to maximize this ratio relative to a pre-set ratio and adjusting the pre-set ratio in accordance with the temperature of the mixture when the temperature is below a pre-determined limit.

2 Claims, 3 Drawing Figures

COATING MIXTURE VISCOSITY VS TEMP.
% LIMESTONE

ASPHALT COATING MIX AUTOMATIC LIMESTONE CONTROL

This application is a continuation of application Ser. No. 302,369, filed Sept. 15, 1981 (now abandoned).

FIELD OF THE INVENTION

The present invention relates to automatic control means for the addition of limestone to the asphalt coating mix for a shingle line.

BACKGROUND TO THE INVENTION

In the manufacture of shingles a mixture of asphalt and limestone or some other suitable inert inexpensive filler (generally referred to as the filled coating mixture) are used to coat the surface of the web prior to the application of the protective granuals. Generally the ratio of asphalt to filler is manually controlled by a proportioning device. To meet government specifications a limited amount of filler may be added and the operator controls the proportioning device to ensure that the resultant mixture does not exceed this upper limit of limestone. Also the mixture must have other characteristics to properly form a shingle during production e.g. viscosity and the operator also adjusts the ratio in the mixture until these characteristics appear to be within specification. However, to ensure that the government regulated amount of limestone is not exceeded requires operation at a level significantly below the maximum level of limestone addition and when the other characteristic requires adjustment for proper operation the amount of limestone is reduced more than required as a safeguard to ensure operation on the equipment.

BRIEF DESCRIPTION OF THE INVENTION

It is the object of the present invention to provide an automatic control means for adjusting the ratio of limestone filler to asphalt to form a coating mixture.

Broadly the present invention comprises means to sense the density of the limestone asphalt mixture which indicates the percent of limestone in the mixture, means to sense the temperature of the mixture, means to adjust a proportioning means to proportion the amount of incoming asphalt to the amount of incoming limestone to maximize the percent of limestone in accordance with a preset limit and means for adjusting said preset limit when the temperature of said mixture is below a preset limit.

BRIEF DESCRIPTION OF THE DRAWINGS

Further features objects and advantages will be evident in the following detailed description of the preferred embodiment of the present invention taken in conjunction with the accompanying drawings in which.

DESCRIPTION OF THE PREFERRED EMBODIMENTS

Figure 1:
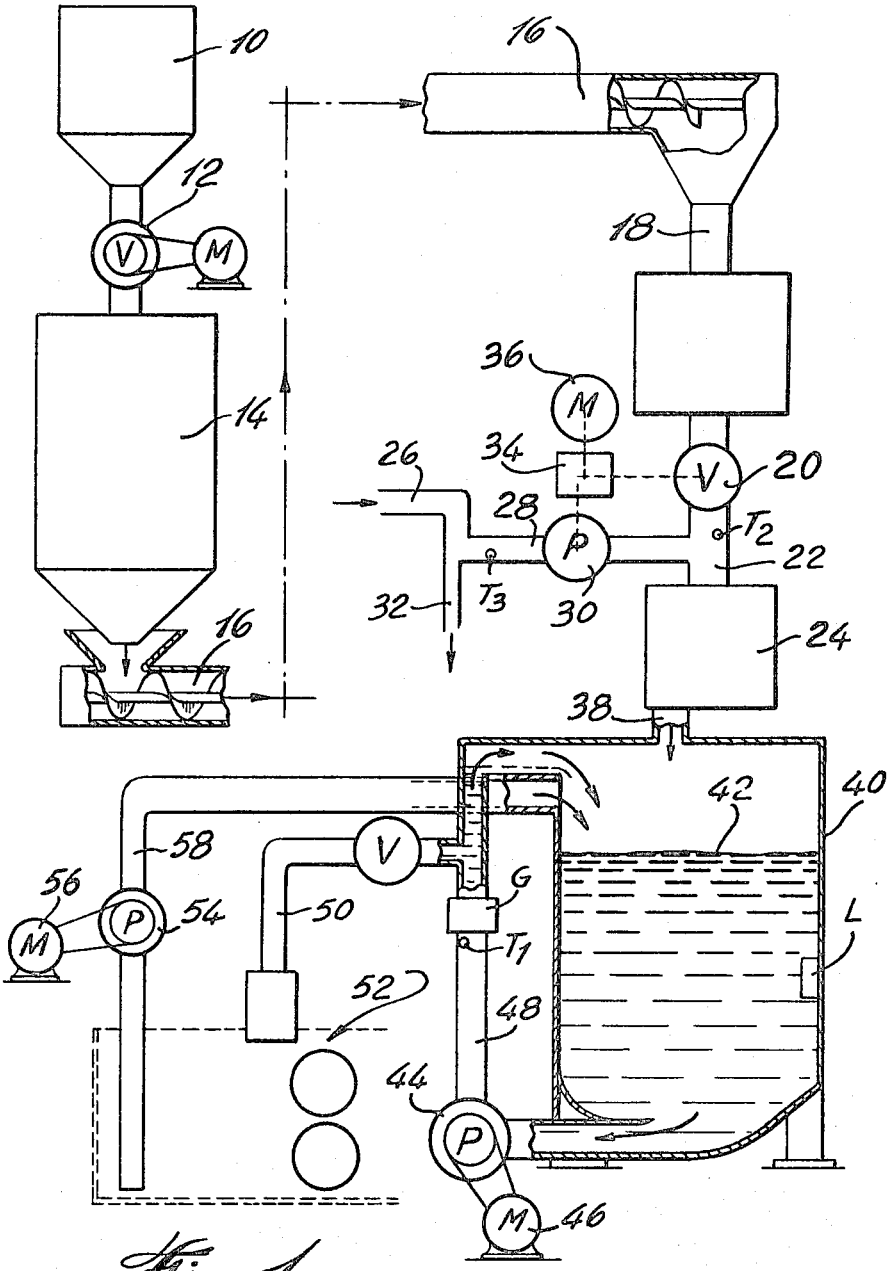
FIG. 1 is a schematic view of the coating asphalt mixing arrangement.
Figure 2:
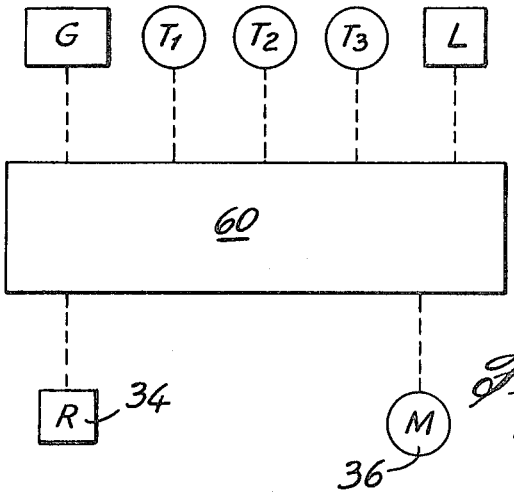
FIG. 2 is a schematic illustration of the control system of the present invention.

As shown in FIG. 1, limestone enters the system from the feeder 10 via a motorized metering valve 12 and passes into a heating chamber 14 provided with suitable heating means not shown to raise the temperature of the limestone in the chamber 14 to the desired temperature. Limestone is then removed from the chamber 14 and fed in the illustrated arrangement via screw feeder 16 into the top of a hopper 18. The limestone leaves the hopper 18 via metering valve 20 and passes through line 22 to into the mixer 24.

Hot asphalt is fed from a tank not shown via line 26 and a portion thereof fed via line 28 and metering pump 30 into the line 22 to enter the mixer 24 with the limestone from hopper 18. Excess asphalt is returned to the tank via line 32.

The ratio of limestone to asphalt is controlled by the proportioning mechanism generally indicated at 34 which drives the pump 30 and valve 20 at the required ratios to have the limestone and asphalt enter the pipe 22 in the required ratio. A suitable motor 36 powers the proportioner 34 and thereby the valve 20 and pump 30 to set the rate of flow of these materials.

The mixture of limestone and asphalt (filled coating mixture) leaves the mixer via line 38 and passes into the holding tank 40 which also may be heated by suitable means not shown. The filled coating mixture is contained within the tank 40 to a level 42 and this level 42 may be sensed by the sensor L. Pump 44 driven by a suitable motor 46 pumps the filled coating mixture from the bottom of the tank 40 via line 48 back to the top of the tank 40 with the required amount of filled coating mixture being bled from the line 48 via line 50 onto the coating unit of the machine as generally indicated at 52. Excess coating mixture from the coating unit 52 is pumped via pump 54 driven by motor 56 through line 58 back to the tank 40. The tank 40 is also normally provided wit a suitable agitating means not shown to hold the limestone in suspension in the asphalt.

A suitable gama gauge G is positioned to survey the material passing through the line 48 and thereby determine the density of the material flowing in the line 48. This density is determined by the ratio of limestone to asphalt since the density of limestone is approximately three times that of the asphalt and thus conversely the density sensed by gauge G permits determining the ratio of limestone to asphalt.

The temperature of the mixture is sensed in the line 48 via temperature sensor T1 whereas the temperature of the limestone entering the pipe 22 is measured by the sensor T2 and the temperature of the asphalt, leaving the line 26 is measured by the sensor T3 in the line 28. These temperatures combined with knowledge of the speeds of the valve 20 and pump 30 (speed of motor 36 and setling of proportioner 34) using a suitable model based on a technique known as the Calman Filtering Technique one can predict the density in the tank 40. The reading of the gauge G will be used to correct the prediction.

In operation the density of material is sensed by the gama gauge G. This information is sent to a central control unit 60 and the ratio of limestone to asphalt may be determined. The temperature T1 is also fed to the central control unit 60 as are the temperatures T2, T3 and the level L. The controller 60 maximizes the ratio of limestone to ashphalt up to a certain maximum permissible limit of limestone (set by government standards required for the particular industry and the particular location). It also ensures that the upper limit on viscosity which is determined by the temperature T1 of the mixture in line 48 is not exceeded. If the temperature T1 is too low (below a preset limit it is essential to reduce the ratio of limestone to asphalt (density of the mixture) to ensure that the viscosity of the filled coating mixture (asphalt, limestone mixture) does not exceed the maximum permissible viscosity limit. The viscosity has a significant bearing on the operation of the shingle forming line. The temperature of the incoming asphalt is usually higher than that of the incoming limestone and therefore the temperature may be adjusted by changing the limestone to asphalt ratio. Sensing T2 and T3 and knowing the specific heats of these materials and their rates of flow permit predicting the correct ratio to obtain a selected temperature and/or density. Also the temperature of the limestone could be adjusted by adding more heat to maintain T1 as required if facilities are available to transfer sufficient heat to the limestone.

Figure 3:
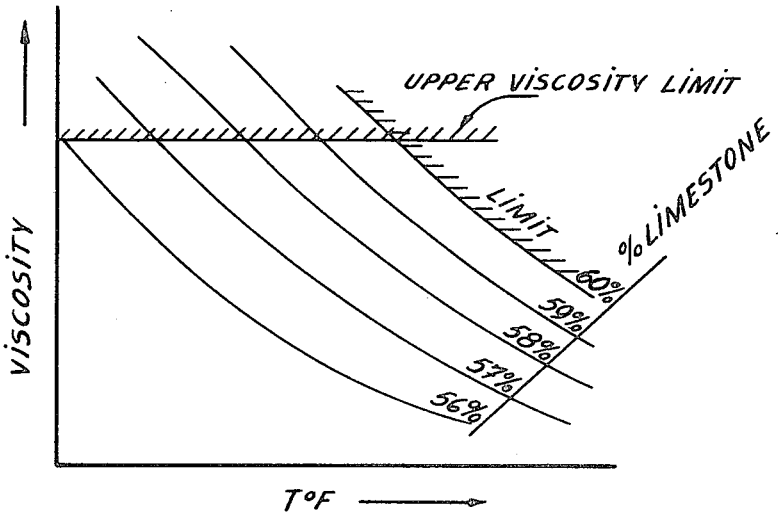
FIG. 3 is a schematic illustration of plots of viscosity versus temperature for different percent limestone in the coating mix.

Referring to FIG. 3, it can be seen, as in the illustrated arrangement, the upper limit of the working range is defined by the upper limit of viscosity and the upper limit of limestone (which has been indicated at 60%). The viscosity is determined by density of the mixture and temperature. Thus, if the temperature decreases, the permissible amount of limestone in the mix also decreases. By sensing the temperature T1, the maximum limit of limestone may be determined whenever T1 is less than the temperature determined by the intersection of the limestone limit with the upper viscosity limit for the particular regulation and equipment being used. Since the reduction in limestone (assume it is at a temperature less than asphalt) will automatically tend to increase the temperature of the mixture, the control means will thus maximize the ratio of asphalt for a set of operating conditions.

The temperature T1 is obviously influenced by the heat applied in the tank 40, however, under normal circumstances the heat applied in tank 40 will be just sufficient to make up for heat losses from the system so that the temperature of the mixture in the tank 40 is primarily determined by the temperature of the asphalt as sensed by temperature sensor T3 and the temperature of limestone as sensed by temperature T2.

The level sensor L may be used to control the motor 36 driving the proportioning mechanism 34 so that when the level 42 in the tank 40 decreases sufficiently the motor is started and material fed to the tank at the level in the tank 40 builds up to a certain maximum height the motor 36 may be turned off.

The disclosure has described primarily limestone as the filler material since it is the filler used however the term is intended to include other suitable fillers.

Having described the present invention modifications will be evident to those skilled in the art without departing from the spirit of the invention as defined in the appended claims.

I claim:

1. An automatic control for regulating and critically controlling ratio differentials of limestone to asphalt in an asphalt coating mixture for a shingle line comprising, mixing means, means to feed limestone and asphalt to said mixing means, means for proportioning the rate of feed of limestone to the rate of feed of asphalt to said mixing means, means for containing the limestone/asphalt mixture, means associated with said containing means for recirculating said mixture in said containing means and thereby maintain said limestone suspended in said mixture, means for sensing the density of said mixture in said recirculating means in order to obtain the ratio of limestone to asphalt in said mixture, means to sense the temperature of said mixture, means to deliver information senses by said means for sensing density and said means to sense the temperature to a control means to automatically adjust said means for proportioning so as to proportion the amount of incoming asphalt to the amount of incoming limestone to maximize the amount of limestone in said mixture in accordance with a pre-set upper limit, and means to adjust said pre-set upper limit when the temperature sensed by said means to sense the temperature of said mixture is below a pre-set temperature level in accordance with the said sensed temperatures.

2. An automatic control as defined in claim 1 further comprising means to sense the temperatures of limestone and asphalt being fed to said mixer and conveying such information to said control means in order to influence said proportioning means.

* * * * *